United States Patent [19]

Abe

[11] 4,328,534

[45] May 4, 1982

[54] CANDLE TYPE ILLUMINATING LAMP

[75] Inventor: Kenichi Abe, Ohmiya, Japan

[73] Assignee: Kabushiki Kaisha Sofard, Tokyo, Japan

[21] Appl. No.: 184,326

[22] Filed: Sep. 5, 1980

[30] Foreign Application Priority Data

Oct. 8, 1979 [JP] Japan ..... 54/138465[U]

[51] Int. Cl.[3] ..... F21V 23/00

[52] U.S. Cl. ..... 362/295; 362/311; 362/363; 362/386; 362/392; 362/810; 313/315

[58] Field of Search ..... 362/295, 311, 363, 386, 362/392, 810; 313/315

[56] References Cited

U.S. PATENT DOCUMENTS 3,194,955 7/1965 Koch ..... 362/810

*Primary Examiner*—Stephen J. Lechert, Jr.

*Attorney, Agent, or Firm*—Wenderoth, Lind & Ponack

[57] ABSTRACT

A lamp body is internally provided with an electromagnet and an electric circuit for exciting the electromagnet intermittently at given time intervals. A movable member having a wick type bulb mounted above the electromagnet is supported by means of a relatively weak spring, the movable member being provided with a magnetic piece attracted by the electromagnet. When the electromagnet is intermittently excited by the electric circuit, the movable member provided with the wick type bulb may be attracted and released whereby the wick type bulb moves and appear to flare.

3 Claims, 2 Drawing Figures

CANDLE TYPE ILLUMINATING LAMP

BACKGROUND OF THE INVENTION

1. Field of the Invention

This invention relates to a candle type illuminating lamp which is capable of appearing just like a real candle.

2. Description of the Prior Art

Conventional candle type illuminating lamps, which are merely shaped in the form of lighted candles formed into a real one, have been commercially available. While these conventional illuminating lamps are convenient without involving any danger, they unavoidably suffer from imitations.

OBJECT OF THE INVENTION

It is an object of this invention to provide an illuminating lamp which causes the wick to flare, thus giving rise to an appearance similar to a real candle.

DETAILED DESCRIPTION OF THE INVENTION

Figure 1:
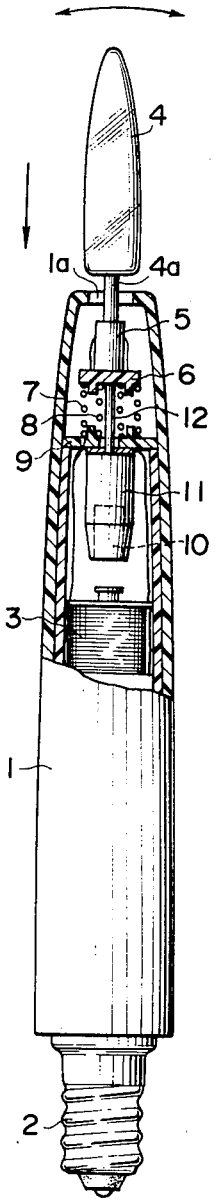
FIG. 1 is a partially cutaway side view of one embodiment in accordance with the present invention.

In FIG. 1, reference numeral 1 denotes a cylindrical lamp body formed of plastics having a base 2 disposed at a lower end thereof, 3 an electromagnet disposed within the lamp body, and 4 a wick type bulb.

The bulb 4 is detachably mounted on a movable body 6 having a small socket 5, and a portion of the bulb above a neck portion 4*a* is extended from the upper opening 1*a* of the lamp body 1. The movable body 6 is supported on a support frame 9 disposed interiorly of the lamp body 1 through inner and outer lead wires and coiled springs 7, 8 formed of a small diameter copper wire. A weight 11 housing is a lower center portion thereof an iron piece 10 is suspended above the electromagnet 3 by a suspension rod 12.

Figure 2:
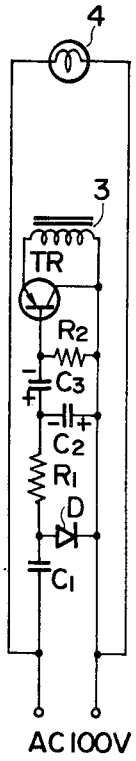
FIG. 2 is an electric circuit diagram therefor.

The lamp body 1 further incorporates therein an electric circuit, as shown in FIG. 2, for energizing the electromagnet 3 at intermittent time intervals.

The electric circuit shown in FIG. 2 comprises a CR, i.e. capacitance-resistance, time constant circuit consisting of capacitors $C_1$, $C_2$, a diode D and a resistor $R_2$, and a switching transistor TR so that the switching transistor TR is placed in conductance at time intervals determined by the CR time constant circuit to energize the electromagnet 3 intermittently.

When the electromagnet 3 is energized, it attracts the weight 11 having the iron piece 10 against the coiled springs 7 and 8, and when a capacitor $C_3$ is discharged, the electromagnet 3 is deenergized to release the weight 11.

With this release of the weight, the weight 11, the movable body 6 and the bulb 4 are moved up and down by the resiliency of the coiled springs 7 and 8 and are oscillated about a support portion of the coiled springs 7 and 8 to present a mode as if a real flame were flaring.

As described above, in the present invention, the wick type bulb appears to flare, and therefore it is very interesting as a candle type illuminating lamp in terms of practical use.

Particularly, if the lamp of the present invention is applied to a candlestand provided with many receptacles, an outstanding decorative effect may be achieved.

I claim:

1. A candle type illuminating lamp comprising:

a lamp body;

an electromagnet positioned within said lamp a movable body positioned within said lamp body;

a wick type bulb mounted on said movable body and positioned outwardly of said lamp body;

relatively weak spring means for supporting said movable body and said bulb for movement generally axially of said lamp body;

a magnetic member attached to said movable body and adapted to be attracted by said electromagnet; and electric circuit means intermittently for energizing said electromagnet and causing said magnetic member to be attracted thereto, thereby moving said movable body and said bulb in a first direction against the force of said spring means, and interrupting said energizing, whereby said spring means move said movable body and bulb in a second direction.

2. A lamp as claimed in claim 1, wherein said spring means, upon said interrupting of said energizing, causes said movable body and said bulb to oscillate in said first and second directions and in lateral directions.

3. A lamp as claimed in claim 1, wherein said electric circuit means comprises a switching transistor and a capacitance-resistance time constant circuit.

* * * * *